US011707650B2

(12) United States Patent
Nakamura et al.

(10) Patent No.: US 11,707,650 B2
(45) Date of Patent: Jul. 25, 2023

(54) GOLF CLUB HEAD

(71) Applicant: SUMITOMO RUBBER INDUSTRIES, LTD., Kobe (JP)

(72) Inventors: Takashi Nakamura, Kobe (JP); Satoru Hanamitsu, Kobe (JP); Shimpei Oyama, Kobe (JP); Yuki Nagano, Kobe (JP); Naoyoshi Ueda, Kobe (JP); Masahiko Ueda, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 266 days.

(21) Appl. No.: 17/181,795

(22) Filed: Feb. 22, 2021

(65) Prior Publication Data

US 2021/0268346 A1 Sep. 2, 2021

(30) Foreign Application Priority Data

Feb. 28, 2020 (JP) ..... 2020-032672

(51) Int. Cl.
*A63B 53/04* (2015.01)

(52) U.S. Cl.
CPC ..... *A63B 53/0466* (2013.01); *A63B 53/0408* (2020.08)

(58) Field of Classification Search
CPC ..... A63B 53/0466; A63B 53/0408; A63B 53/0433; A63B 53/0437
USPC ..... 473/324–350, 287–292
See application file for complete search history.

(56) References Cited

U.S. PATENT DOCUMENTS 6,348,013 B1 * 2/2002 Kosmatka ..... A63B 60/00 473/345
6,440,008 B2 * 8/2002 Murphy ..... B29C 70/865 473/324
6,929,566 B2 * 8/2005 Sano ..... A63B 53/0466 420/420
7,097,572 B2 * 8/2006 Yabu ..... A63B 60/46 473/345

(Continued)

FOREIGN PATENT DOCUMENTS

JP 2010-279847 A 12/2010

OTHER PUBLICATIONS

JP-2019198352-A, "Golf club head and golf club set", by Kitazaki Takahashi, published Nov. 21, 2019, with translation attached. (Year: 2019).*

(Continued)

*Primary Examiner* — Sebastiano Passaniti
(74) *Attorney, Agent, or Firm* — Birch, Stewart, Kolasch & Birch, LLP

(57) ABSTRACT

In a head, a center vertical cross section passing through a face center satisfies the following (a) and (b):
(a) when a boundary point between an inner surface of a crown portion and an inner surface of a face portion is defined as a CF inner surface boundary point, a curvature radius of a head inner surface at the CF inner surface boundary point is 6.0 mm or greater and 10.0 mm or less, and the head thickness at the CF inner surface boundary point is 2.0 mm or greater; and
(b) when a spot located 10 mm apart from the CF inner surface boundary point toward the crown side is defined as a spot C10, the head thickness reduces gradually from the CF inner surface boundary point to the spot C10, and the head thickness at the spot C10 is 1.0 mm or less.

15 Claims, 9 Drawing Sheets

(56) References Cited

U.S. PATENT DOCUMENTS

| | | | | |
|---|---|---|---|---|
| 7,699,719 | B2 * | 4/2010 | Sugimoto | A63B 53/0466 473/345 |
| 7,762,909 | B2 * | 7/2010 | Sugimoto | A63B 53/0466 473/346 |
| 7,775,904 | B2 * | 8/2010 | Hirano | A63B 60/54 473/332 |
| 7,819,758 | B2 * | 10/2010 | Matsunaga | A63B 53/0466 473/345 |
| 8,038,546 | B2 * | 10/2011 | Yokota | A63B 53/0466 473/346 |
| 8,182,366 | B2 * | 5/2012 | Horacek | A63B 53/0466 473/345 |
| 8,272,975 | B2 * | 9/2012 | Morin | A63B 60/00 473/342 |
| 9,017,187 | B2 * | 4/2015 | Abe | A63B 53/0466 473/329 |
| 10,035,048 | B2 * | 7/2018 | Stokke | A63B 53/0466 |
| 10,265,588 | B2 * | 4/2019 | Aramaki | A63B 53/0466 |
| 10,864,413 | B2 * | 12/2020 | Stokke | A63B 53/0466 |
| 11,083,935 | B2 * | 8/2021 | Jertson | A63B 53/0466 |
| 11,130,027 | B2 * | 9/2021 | Chao | A63B 60/02 |
| 11,167,185 | B2 * | 11/2021 | Bacon | A63B 53/0408 |
| 2003/0162607 | A1 * | 8/2003 | Tsunoda | A63B 53/0466 473/324 |
| 2006/0172819 | A1 * | 8/2006 | Sano | A63B 53/0466 473/345 |
| 2009/0017938 | A1 * | 1/2009 | Yokota | A63B 53/0466 473/349 |
| 2010/0022328 | A1 * | 1/2010 | Yokota | A63B 53/0466 473/349 |
| 2017/0304689 | A1 * | 10/2017 | Takagi | A63B 53/0466 |
| 2021/0128993 | A1 * | 5/2021 | Willett | A63B 60/52 |
| 2022/0219050 | A1 * | 7/2022 | Nakamura | A63B 53/0466 |
| 2022/0226699 | A1 * | 7/2022 | Mizutani | A63B 53/0466 |
| 2022/0233921 | A1 * | 7/2022 | Mizutani | A63B 53/0433 |
| 2022/0249921 | A1 * | 8/2022 | Mizutani | A63B 53/0466 |

OTHER PUBLICATIONS

JP-2004057645-A ,"Golf club head", by Mine, Takayuki, published Feb. 26, 2004, see Abstract. (Year: 2004).*

JP-2007037921-A, "Golf club head and golf club", by Ota, Tasuyuki etal, published Feb. 15, 2007, see Abstract. (Year: 2007).*

JP-2019071983-A, "Golf club head", by Nakahara Norihiko, published May 16, 2019, with attached translation. (Year: 2019).*

Machine translation of JP-2007037921-A, "Golf club head and golf club", by Ota, Yasuyuki et al, (Year: 2023).*

* cited by examiner

GOLF CLUB HEAD

The present application claims priority on Patent Application No. 2020-32672 filed in Japan on Feb. 28, 2020. The entire contents of this Japanese Patent Application are hereby incorporated by reference.

BACKGROUND OF THE INVENTION

Field of the Invention

The present disclosure relates to a golf club head.

Description of the Related Art

As a structure for enhancing the rebound performance of a wood-type golf club head having a hollow portion, providing a low-rigidity portion such as a groove in a body portion other than a face portion has been known. JP2010-279847A discloses a golf club head having a fold portion in a head main portion.

SUMMARY OF THE INVENTION

The rebound performance can be enhanced by allowing not only a face portion but also a body portion to be deformed. The inventors of the present disclosure have found through in-depth studies that providing a groove or the like in the body portion does not allow the body portion to be sufficiently deformed. In light of the foregoing, the present disclosure provides a golf club head with high rebound performance.

In one aspect, the present disclosure provides a golf club head with a hollow structure, including: a face portion including a hitting face; a crown portion; and a sole portion. The hitting face has a face center. A center vertical cross section that passes through the face center and extends in a face-back direction satisfies the following conditions (a) and (b):

(a) when a boundary point between an inner surface of the crown portion and an inner surface of the face portion is defined as a CF inner surface boundary point, a radius of curvature of a head inner surface at the CF inner surface boundary point is greater than or equal to 6.0 mm and less than or equal to 10.0 mm, and a head thickness at the CF inner surface boundary point is greater than or equal to 2.0 mm; and (b) when a spot that is located 10 mm apart from the CF inner surface boundary point toward a crown side (back side) is defined as a spot C10, the head thickness reduces gradually from the CF inner surface boundary point to the spot C10, and the head thickness at the spot C10 is less than or equal to 1.0 mm.

In another aspect, the present disclosure provides a golf club head with a hollow structure, including: a face portion including a hitting face; a crown portion; and a sole portion. The hitting face has a face center. A center vertical cross section that passes through the face center and extends in a face-back direction satisfies the following conditions (c) and (d):

(c) when a boundary point between an inner surface of the sole portion and an inner surface of the face portion is defined as an SF inner surface boundary point, a radius of curvature of a head inner surface at the SF inner surface boundary point is greater than or equal to 4.0 mm and less than or equal to 8.0 mm, and a head thickness at the SF inner surface boundary point is greater than or equal to 2.0 mm; and (d) when a spot that is located 15 mm apart from the SF inner surface boundary point toward a sole side is defined as a spot S15, the head thickness reduces gradually from the SF inner surface boundary point to the spot S15, and the head thickness at the spot S15 is less than or equal to 1.0 mm.

DESCRIPTION OF THE PREFERRED EMBODIMENTS

Embodiments of the present disclosure will be described in detail below with reference to the drawings as necessary.

The following terms are defined in the present disclosure.

[Reference State, Reference Perpendicular Plane]

Figure 9:
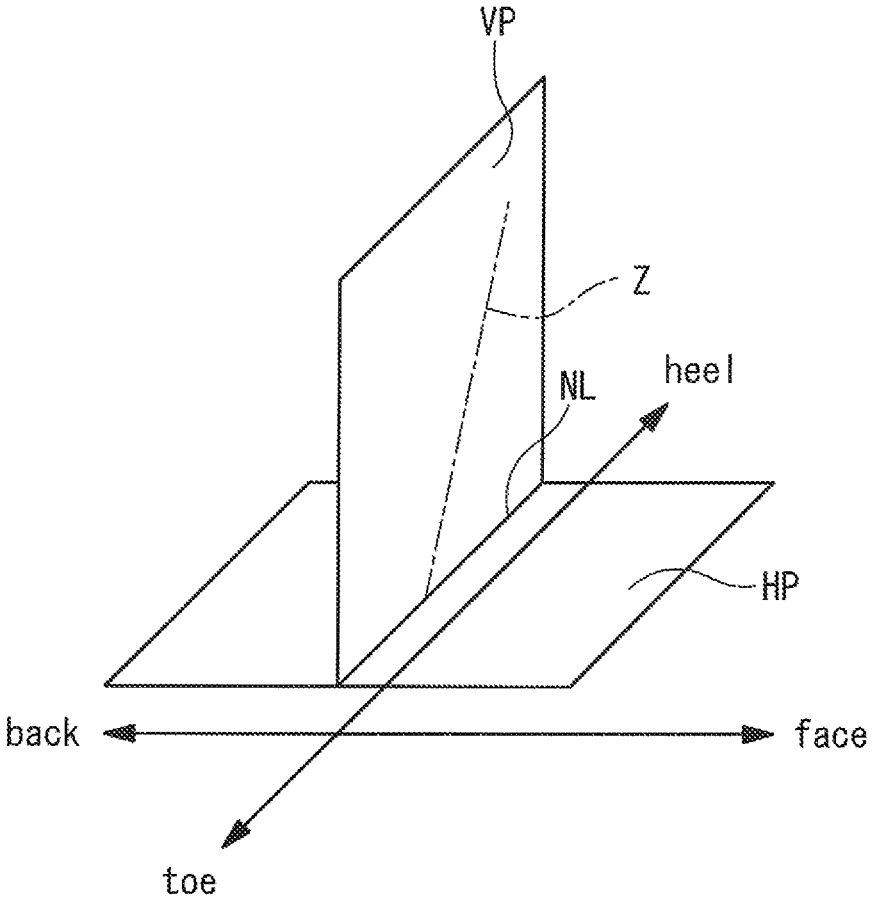
FIG. 9 is a conceptual diagram for illustrating a reference state.

The reference state is a state where a head is placed at a predetermined lie angle and a predetermined face angle on a horizontal plane HP. As shown in FIG. 9, in the reference state, a plane VP perpendicular to the horizontal plane HP includes a center line Z of a hosel hole. The plane VP is defined as a reference perpendicular plane. The predetermined lie angle and the predetermined face angle are shown in product catalogues, for example.

[Toe-Heel Direction]

The toe-heel direction is a direction in which an intersection line NL between the reference perpendicular plane VP and the horizontal plane HP extends (see FIG. 9).

[Face-Back Direction]

The face-back direction is a direction perpendicular to the toe-heel direction and parallel to the horizontal plane HP.

[Up-Down Direction]

The up-down direction is a direction perpendicular to the toe-heel direction and perpendicular to the face-back direction.

[Face Center]

The face center is determined in the following manner. First, a point Pr is selected roughly at the center of a face surface in the up-down direction and the toe-heel direction. Next, a plane that passes through the point Pr, extends in the direction of a line normal to the face surface at the point Pr, and is parallel to the toe-heel direction is determined. An intersection line between this plane and the face surface is drawn, and a midpoint Px of this intersection line is determined. Next, a plane that passes through the midpoint Px, extends in the direction of a line normal to the face surface at the midpoint Px, and is parallel to the up-down direction is determined. An intersection line between this plane and the face surface is drawn, and a midpoint Py of this intersection line is determined. Next, a plane that passes through the midpoint Py, extends in the direction of a line normal to the face surface at the midpoint Py, and is parallel to the toe-heel direction is determined. An intersection line between this plane and the face surface is drawn, and a midpoint Px of this intersection line is newly determined. Next, a plane that passes through this newly-determined midpoint Px, extends in the direction of a line normal to the face surface at this midpoint Px, and is parallel to the up-down direction is determined. An intersection line between this plane and the face surface is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center.

Figure 1:
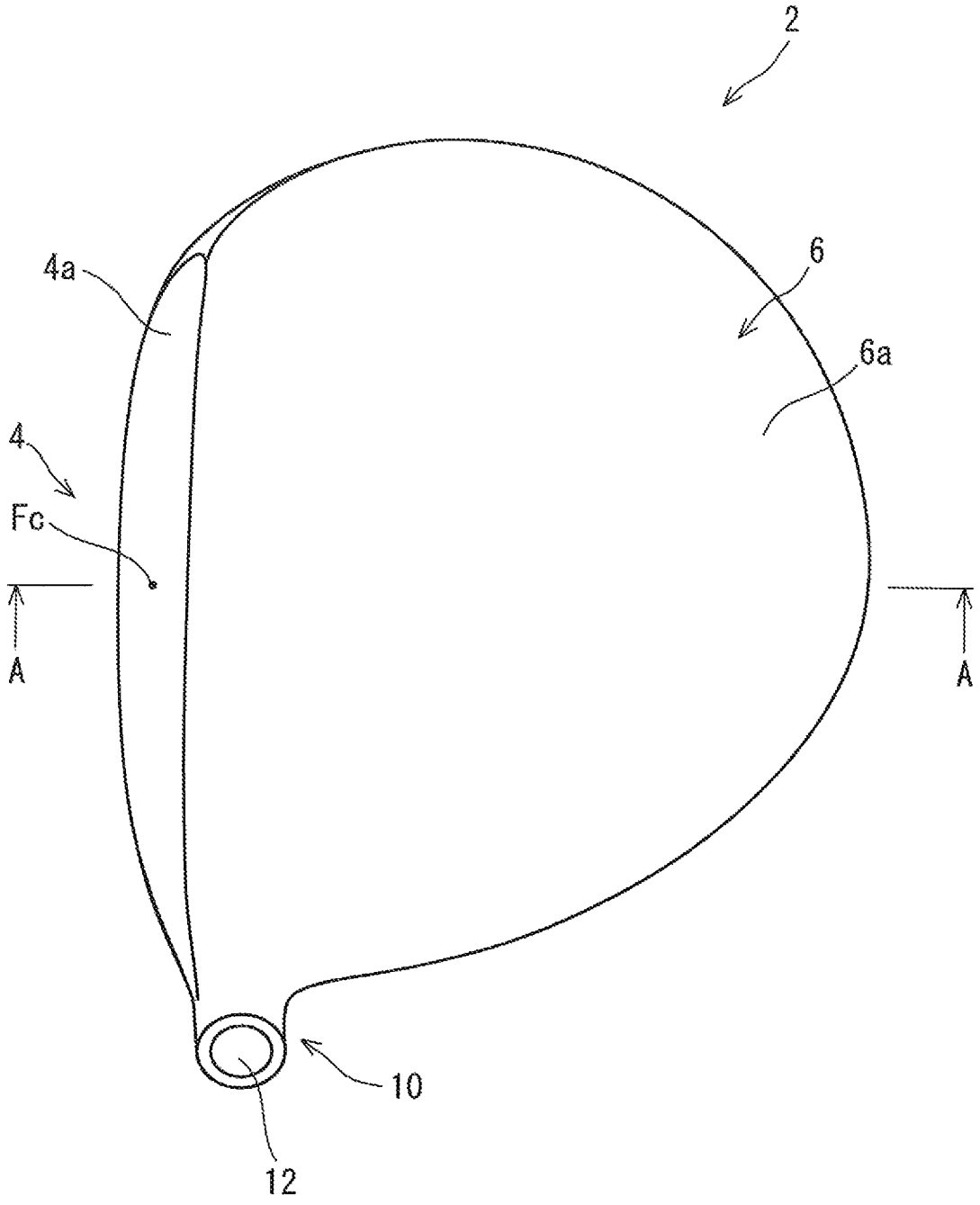
FIG. 1 is a plan view of a golf club head according to a first embodiment.
Figure 2:
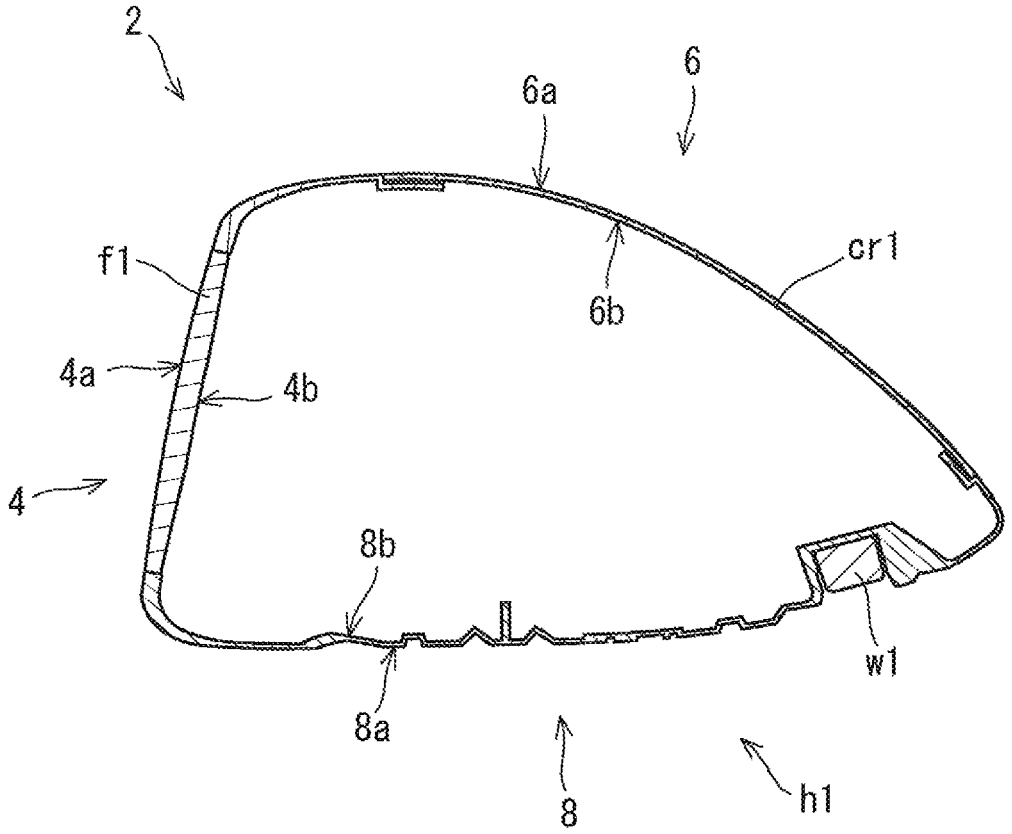
FIG. 2 is a cross-sectional view taken along line A-A in FIG. 1.

FIG. 1 is a plan view of a golf club head 2 according to a first embodiment. FIG. 2 is a cross-sectional view taken along line A-A in FIG. 1. FIG. 2 shows a cross section that passes through the face center Fc.

The head 2 includes a face portion 4, a crown portion 6, a sole portion 8, and a hosel portion 10. The face portion 4 includes a face outer surface 4*a* and a face inner surface 4*b*. The face outer surface 4*a* is a hitting face, which comes into contact with a ball. The face inner surface 4*b* is an inner surface of the face portion 4. The crown portion 6 includes a crown outer surface 6*a* and a crown inner surface 6*b*. The sole portion 8 includes a sole outer surface 8*a* and a sole inner surface 8*b*. The hosel portion 10 has a hosel hole 12. The head 2 is hollow. The face inner surface 4*b*, the crown inner surface 6*b*, and the sole inner surface 8*b* face a hollow portion of the head 2. The face inner surface 4*b*, the crown inner surface 6*b*, and the sole inner surface 8*b* constitute a head inner surface. The face outer surface 4*a*, the crown outer surface 6*a*, and the sole outer surface 8*a* constitute a head outer surface. The head 2 is a head of a driver (number one wood).

The face outer surface 4*a* (hitting face) has the face center Fc. Although score lines (grooves) are formed on the face outer surface 4*a*, these score lines are omitted in all the drawings in the present disclosure.

The face outer surface 4*a* is a three-dimensional curved surface that projects outward. The face outer surface 4*a* includes a bulge and a roll.

In terms of constituent members, the head 2 includes a head body h1, a face insert f1, and a crown member cr1. The head 2 further includes a weight w1. The head body h1 has a face opening, and the face insert f1 is disposed in the face opening. The face insert f1 is a plate-shaped member. The face insert f1 constitutes a portion including the face center Fc in the face portion 4. The face insert f1 constitutes a central portion of the face portion 4, and the head body h1 constitutes a peripheral portion of the face portion 4. The head body h1 has a crown opening, and the crown member cr1 is disposed in the crown opening.

The material of the head body h1 is not limited, and is preferably a metal. Examples of the metal include at least one metal selected from pure titanium, titanium alloys, stainless steel, maraging steel, aluminum alloys, magnesium alloys, and tungsten-nickel alloys.

The material of the face insert f1 is not limited, and is preferably a metal. From the viewpoint of the strength, titanium alloys and maraging steel are preferable as the material of the face insert f1. From the viewpoint of the strength, the face insert f1 may be produced by pressing a plate material. The plate material may be a rolled material. Rolled materials have few defects and high strength. Besides, rolled materials are produced with high thickness accuracy. The thickness accuracy of the face portion 4 is improved by using a rolled material. The face insert f1 may be produced also by forging, for example.

Examples of the material of the crown member cr1 include metals and carbon fiber reinforced plastics (CFRP). From the viewpoint of lowering the center of gravity of the head, carbon fiber reinforced plastics (CFRP) are preferable.

The face insert f1 and the crown member cr1 need not necessarily be used. Also, a so-called cup face member may be used to form the face portion 4. The cup face member includes the entirety of the face portion 4, a portion that extends from the upper edge of the face portion 4 toward the back side to constitute a part of the crown portion 6, and a portion that extends from the lower edge of the face portion 4 toward the back side to constitute a part of the sole portion 8.

Figure 3:
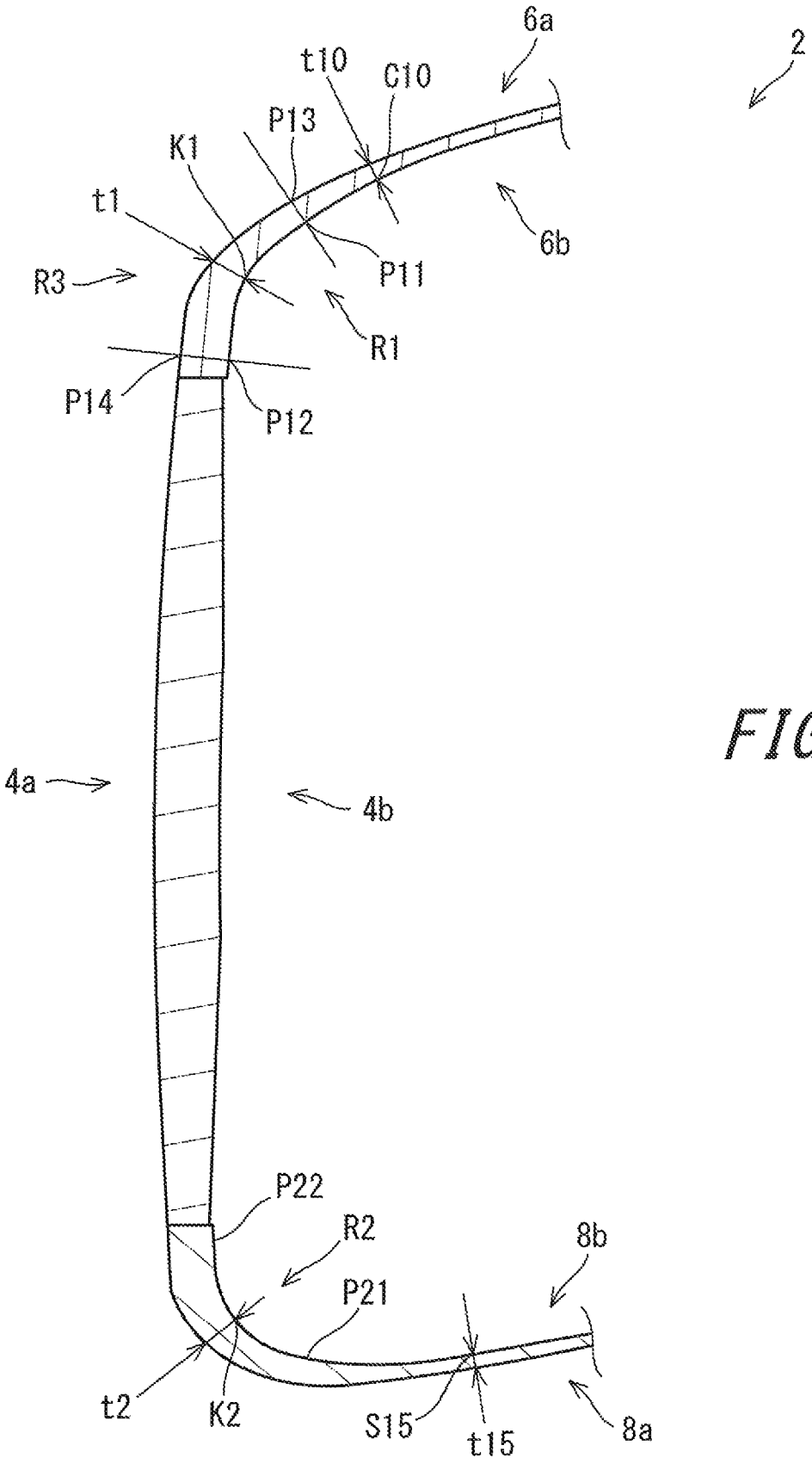
FIG. 3 is a fragmentary enlarged view of FIG. 2.

FIG. 3 shows a vertical cross section that passes through the face center Fc and extends in the face-back direction. This cross section extends in the face-back direction and also in the up-down direction. This cross section is also referred to as a "center vertical cross section" in the present disclosure. Cross sections that extend in the face-back direction and the up-down direction are determined at respective positions in the toe-heel direction. The cross sections that extend in the face-back direction and the up-down direction are also referred to as "vertical cross sections" in the present disclosure. The center vertical cross section is one of the vertical cross sections.

In the present disclosure, a CF inner surface boundary point, a CF boundary region, and a spot C10 are defined in each of the above-described vertical cross sections. The CF inner surface boundary point, the CF boundary region, and the spot C10 are determined in each of the vertical cross sections at respective positions in the toe-heel direction.

The CF inner surface boundary point is a boundary point between the crown inner surface 6*b* and the face inner surface 4*b*. In the vicinity of the boundary between the crown inner surface 6*b* and the face inner surface 4*b*, a spot where the radius of curvature in the vertical cross section is the smallest is the CF inner surface boundary point. In the case where the spot where the radius of curvature is the smallest is not a point but a curved line (arc), the midpoint of the curved line is the CF inner surface boundary point.

The CF boundary region is a region on the inner surface of the head. The CF boundary region is a region having a distance of less than or equal to 5 mm from the CF inner surface boundary point. When a spot located 5 mm apart from the CF inner surface boundary point toward the crown side (back side) is defined as a spot P11 and a spot located 5 mm apart from the CF inner surface boundary point toward the face side is defined as a spot P12, the CF boundary region is a region extending from the spot P11 to the spot P12. The above-described distances (5 mm) are a path length measured along the contour line of the inner surface of the head in the vertical cross section.

In the present disclosure, an SF inner surface boundary point, an SF boundary region, and a spot S15 are defined in each of the above-described vertical cross sections. The SF inner surface boundary point, the SF boundary region, and the spot S15 are determined in each of the vertical cross sections at respective positions in the toe-heel direction.

The SF inner surface boundary point is a boundary point between the sole inner surface 8*b* and the face inner surface 4*b*. In the vicinity of the boundary between the sole inner surface 8*b* and the face inner surface 4*b*, a spot where the radius of curvature in the vertical cross section is the smallest is the SF inner surface boundary point. In the case where the spot where the radius of curvature is the smallest is not a point but a curved line (arc), the midpoint of the curved line is the SF inner surface boundary point.

The SF boundary region is a region on the inner surface of the head. The SF boundary region is a region having a distance of less than or equal to 5 mm from the SF inner surface boundary point. When a spot located 5 mm apart from the SF inner surface boundary point toward the sole side is defined as a spot P21 and a spot located 5 mm apart from the SF inner surface boundary point toward the face side is defined as a spot P22, the SF boundary region is a region extending from the spot P21 to the spot P22. The above-described distances (5 mm) are a path length measured along the contour line of the inner surface of the head in the vertical cross section.

In the present disclosure, the contour lines in the vertical cross section are used to measure a radius of curvature. The radius of curvature at a certain point (hereinafter referred to as "point A") is the radius of a circle that passes through three points, namely, the point A, a point located 1 mm apart from the point A toward one side of the point A, and another point located 1 mm apart from the point A toward the other side of the point A. In the above, "1 mm" is a path length measured along the contour line in the vertical cross section. For example, the radius of curvature at the CF inner surface boundary point K1 is the radius of a circle that passes through three points, namely, a spot located 1 mm apart from the CF inner surface boundary point K1 toward the crown side, a spot located 1 mm apart from the CF inner surface boundary point K1 toward the face side, and the CF inner surface boundary point K1. For example, the radius of curvature at the SF inner surface boundary point K2 is the radius of a circle that passes through three points, namely, a spot located 1 mm apart from the SF inner surface boundary point K2 toward the sole side, a spot located 1 mm apart from the SF inner surface boundary point K2 toward the face side, and the SF inner surface boundary point K2.

In the present disclosure, the vertical cross section is used to measure the head thickness. The head thickness is measured along a line normal to the contour line of the head inner surface in the vertical cross section. This normal line is a line perpendicular to the tangent line at the measurement point of the head thickness.

As shown in FIG. 3, the contour line of the head inner surface in the vertical cross section includes the CF inner surface boundary point K1, the CF boundary region R1, and the spot C10. For indicating "spot C10", the reference numeral "C10" which is the same as the spot name is used. The contour line of the head inner surface in the vertical cross section includes the spot P11 located 5 mm apart from the CF inner surface boundary point K1 toward the crown side (back side) and the spot P12 located 5 mm apart from the CF inner surface boundary point K1 toward the face side (lower side). The CF boundary region R1 is a region extending from the spot P11 to the spot P12. A double-pointed arrow t1 indicates the head thickness at the CF inner surface boundary point K1. A double-pointed arrow t10 indicates the head thickness at the spot C10.

In the head 2, the center vertical cross section satisfies the following conditions (a) and (b).

(a) The radius of curvature of the head inner surface at the CF inner surface boundary point K1 is greater than or equal to 6.0 mm and less than or equal to 10.0 mm, and the head thickness t1 at the CF inner surface boundary point K1 is greater than or equal to 2.0 mm.

(b) The head thickness reduces gradually from the CF inner surface boundary point K1 to the spot C10, and the head thickness t10 at the spot C10 is less than or equal to 1.0 mm.

In the head 2, the center vertical cross section satisfies the following condition (a1).

(a1) When a region having a distance of less than or equal to 5 mm from the CF inner surface boundary point K1 is defined as the CF boundary region, the radius of curvature of the head inner surface in the CF boundary region is greater than or equal to 6.0 mm and less than or equal to 10.0 mm.

In the condition (a1), the radius of curvature of the head inner surface is greater than or equal to 6.0 mm and less than or equal to 10.0 mm at any point that belongs to the CF boundary region R1.

As shown in FIG. 3, the contour line of the head inner surface in the vertical cross section includes the SF inner surface boundary point K2, the SF boundary region R2, and the spot S15. For indicating "spot S15", the reference numeral "S15" which is the same as the spot name is used. The contour line of the head inner surface in the vertical cross section includes the spot P21 located 5 mm apart from the SF inner surface boundary point K2 toward the sole side (back side) and a spot P22 located 5 mm apart from the SF inner surface boundary point K2 toward the face side (lower side). The SF boundary region R2 is a region extending from the spot P21 to the spot P22. A double-pointed arrow t2 indicates the head thickness at the SF inner surface boundary point K2. A double-pointed arrow t15 indicates the head thickness at the spot S15.

In the head 2, the center vertical cross section satisfies the following conditions (c) and (d).

(c) The radius of curvature of the head inner surface at the SF inner surface boundary point K2 is greater than or equal to 4.0 mm and less than or equal to 8.0 mm, and the head thickness t2 at the SF inner surface boundary point K2 is greater than or equal to 2.0 mm.

(d) The head thickness reduces gradually from the SF inner surface boundary point K2 to the spot S15, and the head thickness t15 at the spot S15 is less than or equal to 1.0 mm.

In the head 2, the center vertical cross section satisfies the following condition (c1).

(c1) When a region having a distance of less than or equal to 5 mm from the SF inner surface boundary point K2 is defined as the SF boundary region, the radius of curvature of the head inner surface in the SF boundary region is greater than or equal to 4.0 mm and less than or equal to 8.0 mm.

In the condition (c1), the radius of curvature of the head inner surface is greater than or equal to 4.0 mm and less than or equal to 8.0 mm at any point that belongs to the SF boundary region R2.

The head 2 exhibits the following functions and effects.

As disclosed in JP2010-279847A described above, as a structure for enhancing the rebound performance of a wood-type golf club head having a hollow portion, providing a low-rigidity portion in a body portion other than a face portion has been known. The rebound performance can be enhanced by allowing not only a face portion but also a body portion to be deformed. However, the inventors of the present disclosure have found that providing a low-rigidity portion such as a groove in the body portion does not allow the face portion to be sufficiently deformed.

The inventors of the present disclosure conducted in-depth studies to find out the reason why the face portion is not deformed sufficiently. As a result, it has been found that, in actual hitting, the starting point of bending is in a boundary portion between the face portion and the body portion, and accordingly, flexure is caused only in the face portion and little flexure is caused in the body portion. As a result, the attempt to increase the flexure of the face portion by the flexure of the body portion have hardly succeeded.

In the present embodiment, the boundary region between the face portion and the body portion is rounded and the thickness of the boundary region is increased. This configuration prevents the bending point from falling within the boundary region, thereby allowing deformation of the face portion to be transmitted to the body side. In addition, by reducing the thickness of the body portion gradually from the boundary toward the body side, flexure of the body portion can be caused efficiently. As a result, the flexure of the face portion is increased by the flexure of the body portion, whereby the rebound performance is enhanced (body flexure effect).

The above condition (a) suppresses the occurrence of bending at the CF inner surface boundary point K1, whereby the starting point of bending can be shifted to the body (crown portion 6) side. Accordingly, the flexure extends to the crown portion 6, whereby the body flexure effect (crown flexure effect) is enhanced. According to the above condition (b), the gradual reduction of the thickness alleviates stress concentration to increase the durability, and in addition, a thin portion provided in the vicinity of the face portion 4 can effectively cause flexure of the body (crown portion 6). The above condition (c) suppresses the occurrence of bending at the SF inner surface boundary point K2 to allow the flexure to extend to the sole portion 8, thereby enhancing the body flexure effect (sole flexure effect) brought about by the flexure of the sole portion 8. According to the above condition (d), the gradual reduction of the thickness alleviates stress concentration to increase the durability, and in addition, a thin portion provided in the vicinity of the face portion 4 can effectively cause flexure of the body (sole portion 8). From the viewpoint of the crown flexure effect, the head preferably satisfies at least one of the conditions (a) and (b) and more preferably satisfies both the conditions (a) and (b).

From the viewpoint of the sole flexure effect, the head preferably satisfies at least one of the conditions (c) and (d) and more preferably satisfies both the conditions (c) and (d). From the viewpoint of enhancing the body flexure effect by utilizing the crown flexure effect and the sole flexure effect, the head still more preferably satisfies the conditions (a), (b), (c), and (d).

The above condition (a1) suppresses the occurrence of bending at the CF inner surface boundary point K1 and further enhances the crown flexure effect. More preferably, the head satisfies the condition (a1). The above condition (c1) suppresses the occurrence of bending at the SF inner surface boundary point K2 and further enhances the sole flexure effect. More preferably, the head satisfies the condition (c1). From the viewpoint of the body flexure effect, the head still more preferably satisfies both the conditions (a1) and (c1).

In the condition (a), the radius of curvature of the head inner surface at the CF inner surface boundary point K1 is greater than or equal to 6.0 mm and less than or equal to 10.0 mm. From the viewpoint of suppressing the occurrence of bending at the CF inner surface boundary point K1 to allow the flexure to extend to the crown portion 6, the radius of curvature of the head inner surface at the CF inner surface boundary point K1 is preferably greater than or equal to 6.0 mm, more preferably greater than or equal to 6.5 mm, and still more preferably greater than or equal to 7.0 mm. From the viewpoint of the shape of the connected portion between the face portion 4 and the crown portion 6, the radius of curvature of the head inner surface at the CF inner surface boundary point K1 is preferably less than or equal to 10.0 mm, more preferably less than or equal to 9.5 mm, and still more preferably less than or equal to 9.0 mm.

In the condition (a), the head thickness t1 at the CF inner surface boundary point K1 is greater than or equal to 2.0 mm. From the viewpoint of suppressing the occurrence of bending at the CF inner surface boundary point K1 to allow the flexure to extend to the crown portion 6, the head thickness t1 at the CF inner surface boundary point K1 is preferably greater than or equal to 2.0 mm, more preferably greater than or equal to 2.1 mm, and still more preferably greater than or equal to 2.2 mm. When the thickness t1 is excessively large, the thickness of a portion around the CF inner surface boundary point K1 also becomes excessively large, whereby the amount of flexure may be reduced. From this viewpoint, the head thickness t1 at the CF inner surface boundary point K1 is preferably less than or equal to 4.0 mm, more preferably less than or equal to 3.8 mm, and still more preferably less than or equal to 3.6 mm.

In the condition (b), the head thickness t10 at the spot C10 is less than or equal to 1.0 mm. From the viewpoint of enhancing the crown flexure effect, the head thickness t10 at the spot C10 is preferably less than or equal to 1.0 mm, more preferably less than or equal to 0.9 mm, and still more preferably less than or equal to 0.8 mm. From the viewpoint of the strength, the head thickness t10 at the spot C10 is preferably greater than or equal to 0.4 mm, more preferably greater than or equal to 0.5 mm, and still more preferably greater than or equal to 0.6 mm.

In the condition (a1), the radius of curvature of the head inner surface in the CF boundary region R1 is greater than or equal to 6.0 mm and less than or equal to 10.0 mm. From the viewpoint of suppressing the occurrence of bending in the CF boundary region R1 to allow the flexure to extend to the crown portion 6, the radius of curvature of the head inner surface in the CF boundary region R1 is preferably greater than or equal to 6.0 mm, more preferably greater than or equal to 6.5 mm, and still more preferably greater than or equal to 7.0 mm. From the viewpoint of the shape of the connected portion between the face portion 4 and the crown portion 6, the radius of curvature of the head inner surface in the CF boundary region R1 is preferably less than or equal to 10.0 mm, more preferably less than or equal to 9.5 mm, and still more preferably less than or equal to 9.0 mm.

In the condition (c), the radius of curvature of the head inner surface at the SF inner surface boundary point K2 is greater than or equal to 4.0 mm and less than or equal to 8.0 mm. From the viewpoint of suppressing the occurrence of bending at the SF inner surface boundary point K2 to allow the flexure to extend to the sole portion 8, the radius of curvature of the head inner surface at the SF inner surface boundary point K2 is preferably greater than or equal to 4.0 mm, more preferably greater than or equal to 5.0 mm, and still more preferably greater than or equal to 6.0 mm. From the viewpoint of the shape of the connected portion between the face portion 4 and the sole portion 8, the radius of curvature of the head inner surface at the SF inner surface boundary point K2 is preferably less than or equal to 8.0 mm, more preferably less than or equal to 7.8 mm, and still more preferably less than or equal to 7.6 mm.

In the condition (c), the head thickness t2 at the SF inner surface boundary point K2 is greater than or equal to 2.0 mm. From the viewpoint of suppressing the occurrence of bending at the SF inner surface boundary point K2 to allow the flexure to extend to the sole portion 8, the head thickness t2 at the SF inner surface boundary point K2 is preferably greater than or equal to 2.0 mm, more preferably greater than or equal to 2.1 mm, and still more preferably greater than or equal to 2.2 mm. When the thickness t2 is excessively large, the thickness of a portion around the SF inner surface boundary point K2 also becomes excessively large, whereby the amount of flexure may be reduced. From this viewpoint, the head thickness t2 at the SF inner surface boundary point K2 is preferably less than or equal to 4.0 mm, more preferably less than or equal to 3.8 mm, and still more preferably less than or equal to 3.6 mm.

In the condition (d), the head thickness t15 at the spot S15 is less than or equal to 1.0 mm. From the viewpoint of enhancing the sole flexure effect, the head thickness t15 at the spot S15 is preferably less than or equal to 1.0 mm, more preferably less than or equal to 0.9 mm, and still more preferably less than or equal to 0.8 mm. From the viewpoint of the strength, the head thickness t15 at the spot S15 is preferably greater than or equal to 0.4 mm, more preferably greater than or equal to 0.5 mm, and still more preferably greater than or equal to 0.6 mm.

In the condition (c1), the radius of curvature of the head inner surface in the SF boundary region R2 is greater than or equal to 4.0 mm and less than or equal to 8.0 mm. From the viewpoint of suppressing the occurrence of bending in the SF boundary region R2 to allow the flexure to extend to the sole portion 8, the radius of curvature of the head inner surface in the SF boundary region R2 is preferably greater than or equal to 4.0 mm, more preferably greater than or equal to 5.0 mm, and still more preferably greater than or equal to 6.0 mm. From the viewpoint of the shape of the connected portion between the face portion 4 and the sole portion 8, the radius of curvature of the head inner surface in the SF boundary region R2 is preferably less than or equal to 8.0 mm, more preferably less than or equal to 7.8 mm, and still more preferably less than or equal to 7.6 mm.

From the viewpoint of suppressing the occurrence of bending in the CF boundary region R1 to allow the flexure to extend to the crown portion 6, the minimum value of the head thickness in the CF boundary region R1 is preferably greater than or equal to 50%, more preferably greater than or equal to 60%, and still more preferably greater than or equal to 70% of the head thickness t1. From the viewpoint of reducing the head thickness t10 at the spot C10, the minimum value of the head thickness in the CF boundary region R1 is preferably less than or equal to 95%, more preferably less than or equal to 90%, and still more preferably less than or equal to 85% of the head thickness t1. In the above embodiment, the minimum head thickness in the CF boundary region R1 is equal to the head thickness at the spot P11.

From the viewpoint of suppressing the occurrence of bending in the SF boundary region R2 to allow the flexure to extend to the sole portion 8, the minimum value of the head thickness in the SF boundary region R2 is preferably greater than or equal to 50%, more preferably greater than or equal to 60%, and still more preferably greater than or equal to 70% of the head thickness t2. From the viewpoint of reducing the head thickness t15 at the spot S15, the minimum value of the head thickness in the SF boundary region R2 is preferably less than or equal to 95%, more preferably less than or equal to 90%, and still more preferably less than or equal to 85% of the head thickness t2. In the above embodiment, the minimum head thickness in the SF boundary region R2 is equal to the head thickness at the spot P21.

Figure 4:
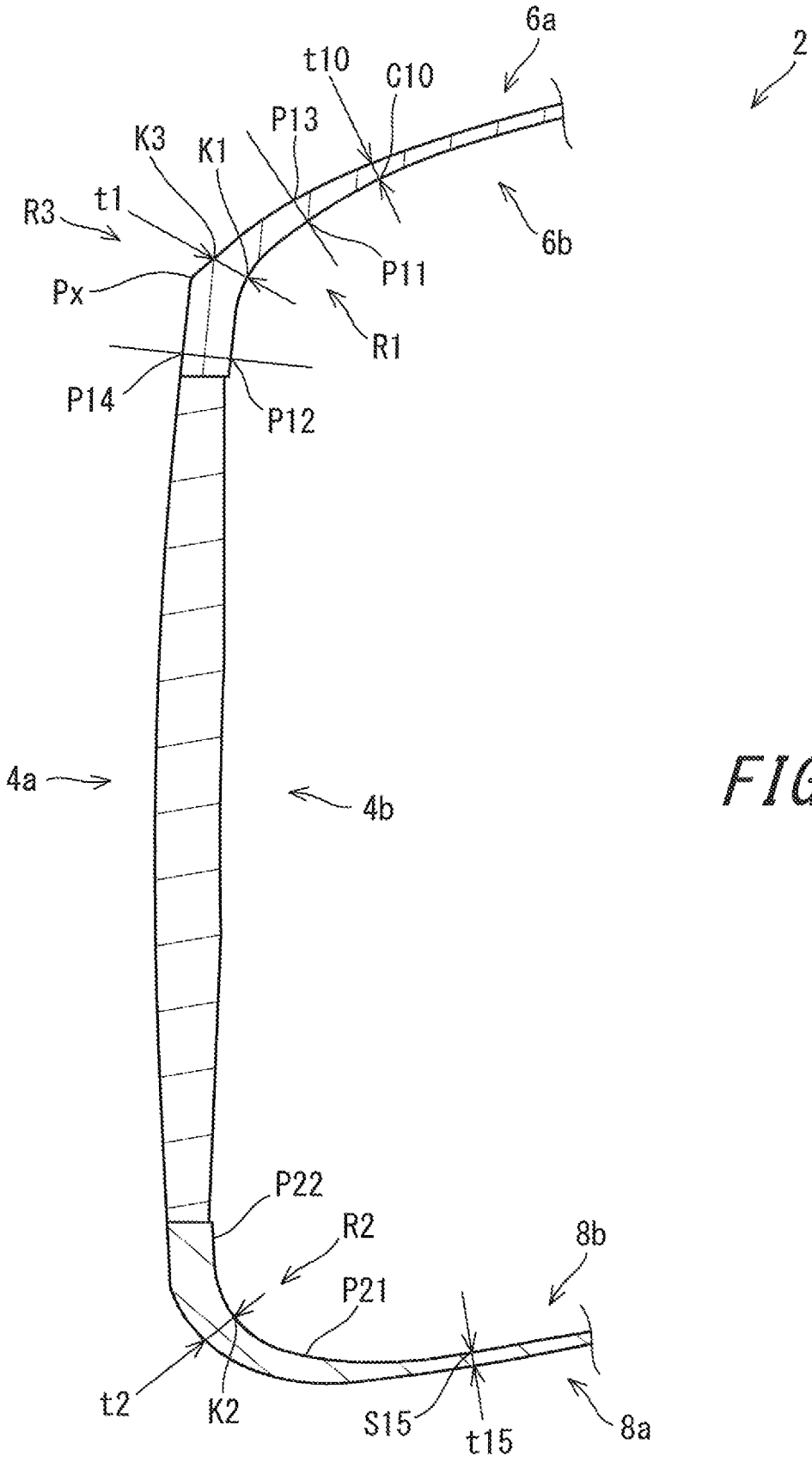
FIG. 4 is a fragmentary enlarged cross-sectional view of a head according to a second embodiment.

FIG. 4 is a fragmentary cross-sectional view showing the center vertical cross section of a head 20 according to a second embodiment. Portions of the head 20 not shown in FIG. 4 are the same as those of the head 2 according to the first embodiment.

A head inner surface of the head 20 has the same shape as the head inner surface of the head 2. A head outer surface of the head 20 has a shape different from that of the head outer surface of the head 2.

The head outer surface includes a CF outer surface boundary region R3. The CF outer surface boundary region R3 is a boundary region between a face outer surface 4*a* and a crown outer surface 6*a*. The CF outer surface boundary region R3 is a region corresponding to the CF boundary region R1. In FIGS. 3 and 4, a spot P13 and a spot P14 are shown on the contour line of the head outer surface in the vertical cross section. The spot P13 is an intersection point between a line normal to the head inner surface at the spot P11 and the head outer surface. The spot P14 is an intersection point between a line normal to the head inner surface at the spot P12 and the head outer surface. A region extending from the spot P13 to the spot P14 is the CF outer surface boundary region R3. The head 20 shown in FIG. 4 satisfies the following condition (e).

(e) The CF outer surface boundary region R3 has an outer surface singularity point Px at which the radius of curvature is smaller than the radius of curvature at the CF inner surface boundary point K1.

The head 2 shown in FIG. 3 does not satisfy the condition (e). In the head 2, the CF outer surface boundary region R3 does not have an outer surface singularity point Px at which the radius of curvature is smaller than the radius of curvature at the CF inner surface boundary point K1.

As shown in FIG. 4, the outer surface singularity point Px is located in the CF outer surface boundary region R3. An intersection point between a line normal to the head inner surface at the CF inner surface boundary point K1 and the head outer surface is an outer surface point K3. The outer surface singularity point Px is located at a position lower than the outer surface point K3. The outer surface singularity point Px is located between the outer surface point K3 and the spot P14. The radius of curvature of the head outer surface at the outer surface singularity point Px is smaller than the radius of curvature of the head inner surface at the CF inner surface boundary point K1.

At address, a golfer directs the hitting face toward a target direction. Owning to the presence of the outer surface singularity point Px, the upper end of the hitting face can be recognized clearly, which allows the golfer to readily know the direction of the hitting face. As described above, the outer surface singularity point Px improves the ease of addressing (visual effect in addressing). Moreover, the outer surface singularity point Px can contribute to increasing the head thickness t1 at the CF inner surface boundary point K1. By increasing the thickness t1, the crown flexure effect is enhanced.

From the viewpoint of increasing the head thickness t1 at the CF inner surface boundary point K1, the outer surface singularity point Px is preferably close to the outer surface point K3. From this viewpoint, the distance between the outer surface singularity point Px and the outer surface point K3 is preferably less than or equal to 4 mm, more preferably less than or equal to 3 mm, and still more preferably less than or equal to 2 mm. This distance is a path length measured along the contour line of the head outer surface in the vertical cross section. This distance may be zero. That is, the outer surface point K3 may be the outer surface singularity point Px.

From the viewpoint of the crown flexure effect and the visual effect in addressing, the radius of curvature of the head outer surface at the outer surface singularity point Px is preferably less than or equal to 5.0 mm, more preferably less than or equal to 4.0 mm, still more preferably less than or equal to 3.0 mm, yet more preferably less than or equal to 2.0 mm, and yet more preferably less than or equal to 1.0 mm. The outer surface singularity point Px may be a corner (angled portion). Also in this case, the definition of the radius of curvature at the outer surface singularity point Px is the same as described above. That is, as described above, three points, namely, the vertex of the corner and points located 1 mm apart from the vertex toward both sides of the vertex are determined, and the radius of a circle that passes through these three points is the radius of curvature at the outer surface singularity point Px.

As described above, vertical cross sections are set at respective positions in the toe-heel direction. With the above-described shape extending in the toe-heel direction, the body flexure effect is enhanced. All the configurations described above are preferably satisfied in the center vertical cross section, more preferably satisfied in any vertical cross section present in a region extending from a position located 10 mm apart toward the toe side from the face center Fc (hereinafter referred to as a first position) to a position located 10 mm apart toward the heel side from the face center Fc (hereinafter referred to as a second position), still more preferably satisfied in any vertical cross section present in a region extending from a position located 15 mm apart toward the toe side from the face center Fc (hereinafter referred to as a third position) to a position located 15 mm apart toward the heel side from the face center Fc (hereinafter referred to as a fourth position), and yet more preferably satisfied in any vertical cross section present in a region extending from a position located 20 mm apart toward the toe side from the face center Fc (hereinafter referred to as a fifth position) to a position located 20 mm apart toward the heel side from the face center Fc (hereinafter referred to as a sixth position). The condition (a) is preferably satisfied in the center vertical cross section, more preferably satisfied in any vertical cross section present in the region extending from the first position located 10 mm apart toward the toe side to the second position located 10 mm apart toward the heel side with respect to the face center Fc, still more preferably satisfied in any vertical cross section present in the region extending from the third position located 15 mm apart toward the toe side to the fourth position located 15 mm apart toward the heel side with respect to the face center Fc, and yet more preferably satisfied in any vertical cross section present in the region extending from the fifth position located 20 mm apart toward the toe side to the sixth position located 20 mm apart toward the heel side with respect to the face center Fc. The condition (b) is preferably satisfied in the center vertical cross section, more preferably satisfied in any vertical cross section present in the region extending from the first position located 10 mm apart toward the toe side to the second position located 10 mm apart toward the heel side with respect to the face center Fc, still more preferably satisfied in any vertical cross section present in the region extending from the third position located 15 mm apart toward the toe side to the fourth position located 15 mm apart toward the heel side with respect to the face center Fc, and yet more preferably satisfied in any vertical cross section present in the region extending from the fifth position located 20 mm apart toward the toe side to the sixth position located 20 mm apart toward the heel side with respect to the face center Fc. The condition (c) is preferably satisfied in the center vertical cross section, more preferably satisfied in any vertical cross section present in the region extending from the first position located 10 mm apart toward the toe side to the second position located 10 mm apart toward the heel side with respect to the face center Fc, still more preferably satisfied in any vertical cross section present in the region extending from the third position located 15 mm apart toward the toe side to the fourth position located 15 mm apart toward the heel side with respect to the face center Fc, and yet more preferably satisfied in any vertical cross section present in the region extending from the fifth position located 20 mm apart toward the toe side to the sixth position located 20 mm apart toward the heel side with respect to the face center Fc. The condition (d) is preferably satisfied in the center vertical cross section, more preferably satisfied in any vertical cross section present in the region extending from the first position located 10 mm apart toward the toe side to the second position located 10 mm apart toward the heel side with respect to the face center Fc, still more preferably satisfied in any vertical cross section present in the region extending from the third position located 15 mm apart toward the toe side to the fourth position located 15 mm apart toward the heel side with respect to the face center Fc, and yet more preferably satisfied in any vertical cross section present in the region extending from the fifth position located 20 mm apart toward the toe side to the sixth position located 20 mm apart toward the heel side with respect to the face center Fc. The condition (a1) is preferably satisfied in the center vertical cross section, more preferably satisfied in any vertical cross section present in the region extending from the first position located 10 mm apart toward the toe side to the second position located 10 mm apart toward the heel side with respect to the face center Fc, still more preferably satisfied in any vertical cross section present in the region extending from the third position located 15 mm apart toward the toe side to the fourth position located 15 mm apart toward the heel side with respect to the face center Fc, and yet more preferably satisfied in any vertical cross section present in the region extending from the fifth position located 20 mm apart toward the toe side to the sixth position located 20 mm apart toward the heel side with respect to the face center Fc. The condition (c1) is preferably satisfied in the center vertical cross section, more preferably satisfied in any vertical cross section present in the region extending from the first position located 10 mm apart toward the toe side to the second position located 10 mm apart toward the heel side with respect to the face center Fc, still more preferably satisfied in any vertical cross section present in the region extending from the third position located 15 mm apart toward the toe side to the fourth position located 15 mm apart toward the heel side with respect to the face center Fc, and yet more preferably satisfied in any vertical cross section present in the region extending from the fifth position located 20 mm apart toward the toe side to the sixth position located 20 mm apart toward the heel side with respect to the face center Fc. The condition (e) is preferably satisfied in the center vertical cross section, more preferably satisfied in any vertical cross section present in the region extending from the first position located 10 mm apart toward the toe side to the second position located 10 mm apart toward the heel side with respect to the face center Fc, still more preferably satisfied in any vertical cross section present in the region extending from the third position located 15 mm apart toward the toe side to the fourth position located 15 mm apart toward the heel side with respect to the face center Fc, and yet more preferably satisfied in any vertical cross section present in the region extending from the fifth position located 20 mm apart toward the toe side to the sixth position located 20 mm apart toward the heel side with respect to the face center Fc.

From the viewpoint of transmitting a force applied to the face portion 4 at impact with a ball to the crown portion 6 and the sole portion 8 to allow the crown portion 6 and the sole portion 8 to be deformed, an intersection angle between the face portion 4 and the crown portion 6 and an intersection angle between the face portion 4 and the sole portion 8 are preferably close to a right angle. Accordingly, a small loft angle is preferable. From this viewpoint, the real loft angle is preferably less than or equal to 14 degrees, more preferably less than or equal to 13 degrees, and still more preferably less than or equal to 12 degrees. From the viewpoint of an appropriate launch angle of the hit ball, the real loft angle is preferably greater than or equal to 7 degrees, more preferably greater than or equal to 7.5 degrees, and still more preferably greater than or equal to 8 degrees.

EXAMPLES

Example 1

A head having the same configuration as the head 2 was produced. A head body h1 was produced by lost-wax precision casting. A titanium alloy was used as the material of the head body h1. A face insert f1 was produced by pressing a rolled material. A titanium alloy was used as the material of the face insert f1. The face insert f1 was attached to a face opening of the head body h1 by welding. A CFRP was used as the material of a crown member cr1. The crown member cr1 was attached to a crown opening of the head body h1 by adhesive bonding.

Example 2 and Comparative Examples 1 to 5

Heads according to Example 2 and Comparative Examples 1 to 5 were obtained in the same manner as in Example 1, except that the specifications of these heads were set as shown in Table 1 below.

The head of Example 2 had the same shape as the head of the above-described second embodiment (FIG. 4). The head of Example 2 had an outer surface singularity point Px.

Figure 5:
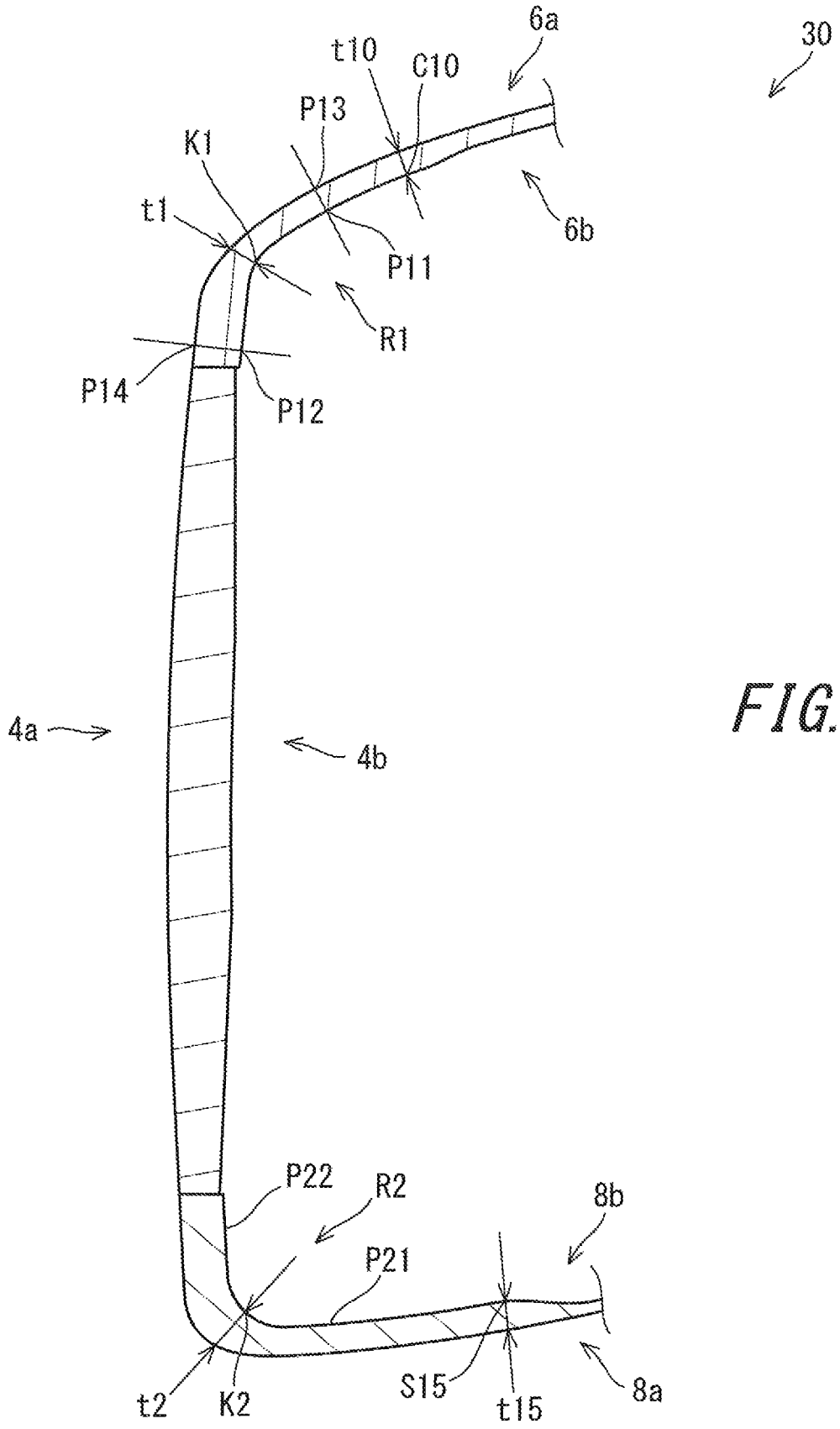
FIG. 5 is a fragmentary enlarged cross-sectional view of a head according to Comparative Example 1.
Figure 6:
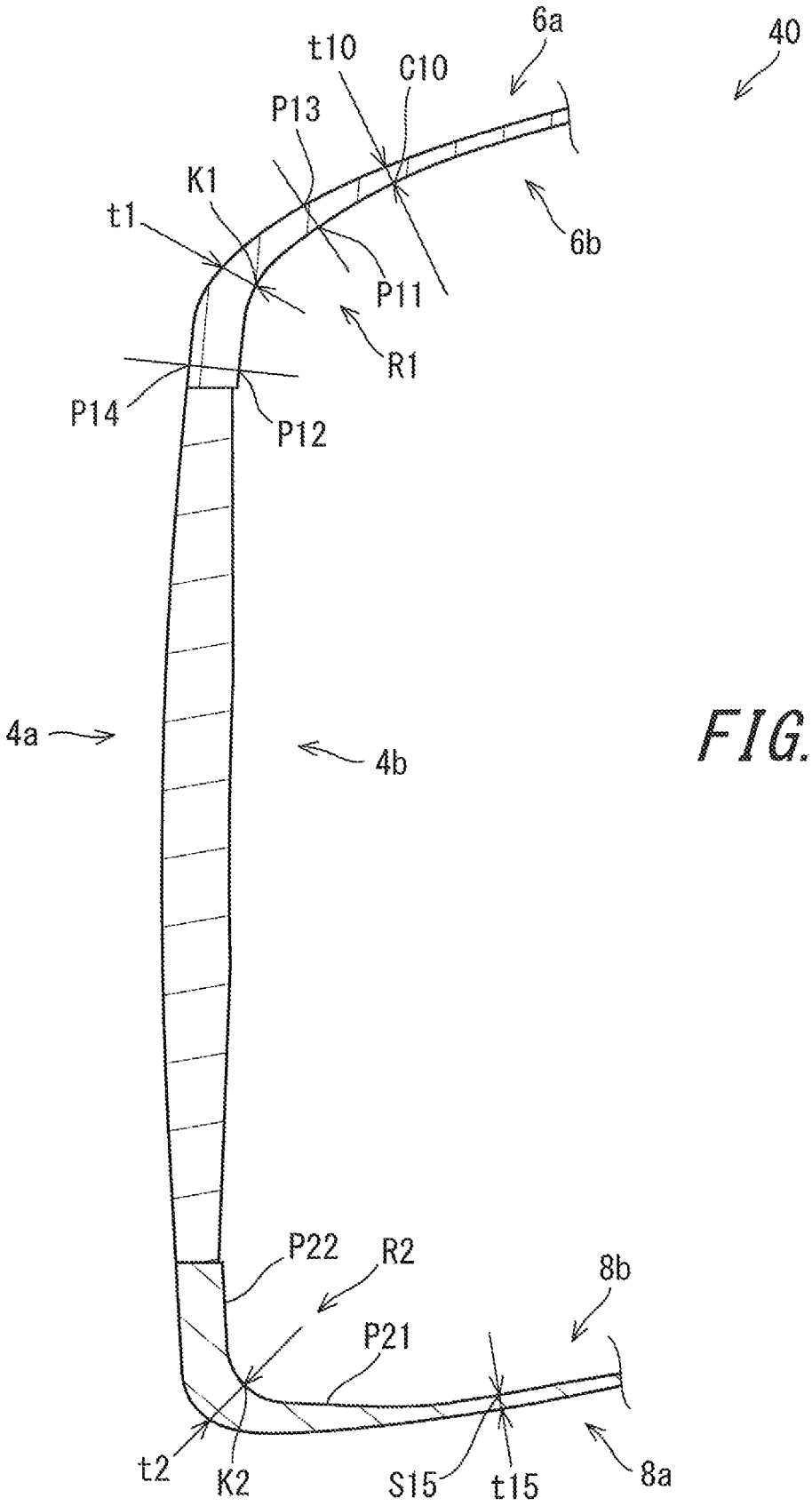
FIG. 6 is a fragmentary enlarged cross-sectional view of a head according to Comparative Example 2.
Figure 7:
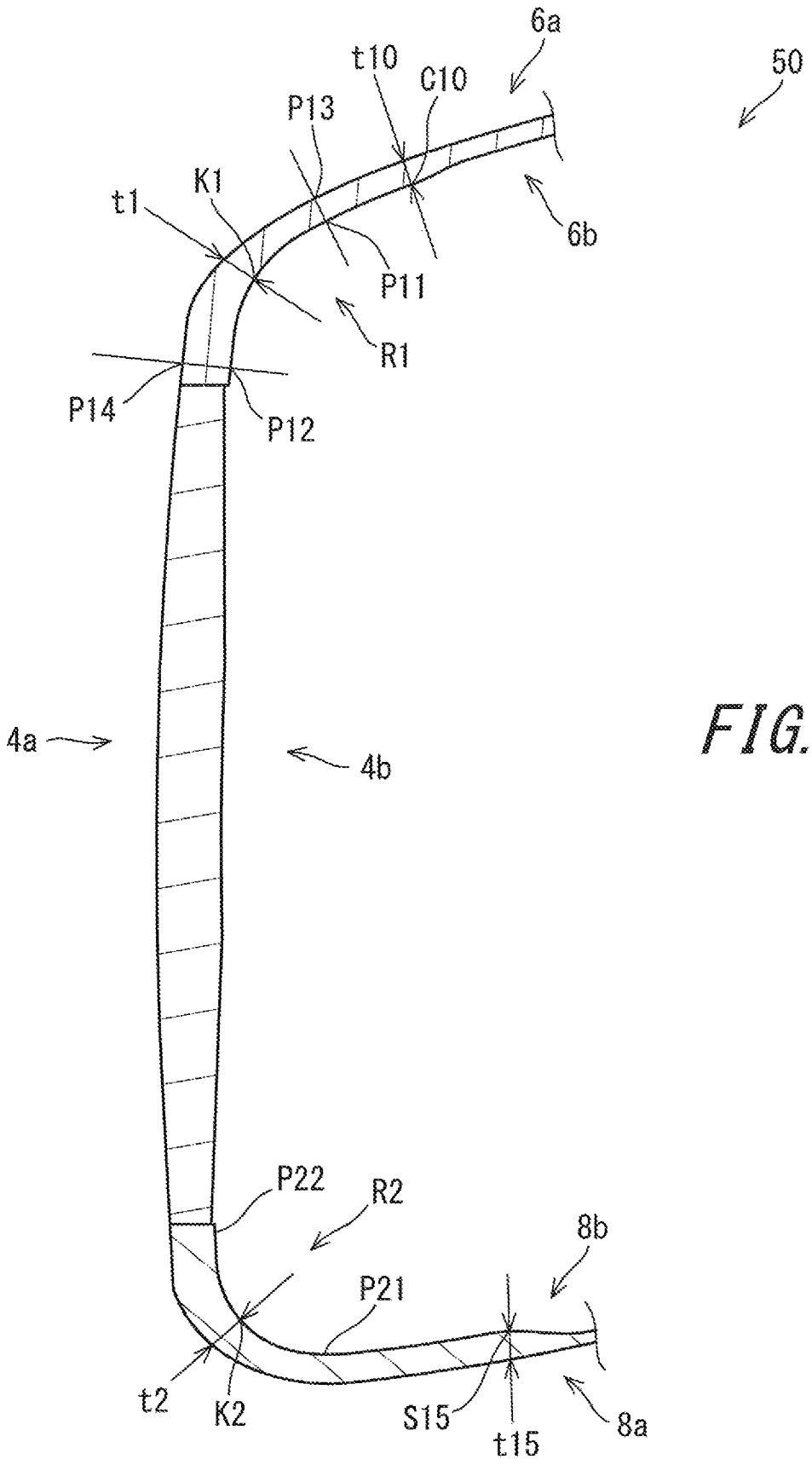
FIG. 7 is a fragmentary enlarged cross-sectional view of a head according to Comparative Example 3.

FIG. 5 is a fragmentary cross-sectional view showing the center vertical cross section of a head 30 of Comparative Example 1. FIG. 6 is a fragmentary cross-sectional view showing the center vertical cross section of a head 40 of Comparative Example 2. FIG. 7 is a fragmentary cross-sectional view showing the center vertical cross section of a head 50 of Comparative Example 3. Portions on the back side of the heads omitted in FIGS. 5 to 7 are the same as those in the head of Example 1. Reference numerals shown in FIGS. 5 to 7 mean the same as the reference numerals shown in FIG. 3.

Table 1 below shows the specifications and evaluation results of the heads of Examples 1 and 2 and Comparative Examples 1 to 5.

TABLE 1

Specifications and evaluation results of Examples and Comarative Examples

| | Unit | Ex. 1 | Ex. 2 | Comp. Ex. 1 | Comp. Ex. 2 | Comp. Ex. 3 | Comp. Ex. 4 | Comp. Ex. 5 |
|---|---|---|---|---|---|---|---|---|
| Radius of curvature at CF inner surface boundary point | mm | 7.3 | 7.3 | 3.0 | 5.0 | 7.0 | 7.0 | 7.0 |
| Head thickness t1 at CF inner surface boundary point | mm | 2.2 | 2.3 | 2.2 | 2.2 | 2.4 | 1.8 | 1.8 |
| Head thickness t10 at spot C10 | mm | 0.8 | 0.8 | 1.3 | 0.9 | 1.3 | 1.3 | 0.8 |
| Radius of curvature at SF inner surface boundary point | mm | 7.3 | 7.3 | 3.0 | 3.0 | 5.5 | 7.1 | 7.1 |
| Head thickness t2 at SF inner surface boundary point | mm | 2.2 | 2.2 | 2.4 | 2.4 | 1.9 | 1.8 | 1.8 |
| Head thickness t15 at spot S15 | mm | 0.8 | 0.8 | 1.5 | 0.8 | 1.5 | 1.5 | 0.8 |
| Presence or absence of outer surface singularity point | — | absent | absent | absent | absent | absent | absent | absent |
| Natural frequency | Hz | 1311 | 1316 | 1372 | 1365 | 1386 | 1362 | 1330 |
| Durability | Number of times | OK | OK | OK | OK | OK | 3200 | 1620 |

The evaluations were made in the following manner.

[Natural Frequency]

A primary natural frequency at the face center Fc was measured. The primary natural frequency means the minimum natural frequency among natural frequencies in the entire head obtained through a modal analysis. As the modal analysis, an experimental modal analysis was conducted. The modal analysis was performed under a fixed-free constraint condition in which only one end is constrained, and the primary natural frequency was measured with the face center Fc being fixed. The results of the measurement are shown in Table 1 above as the natural frequency. The natural frequency indicates the flexibility of the head. The lower the natural frequency, the more flexible the head, which means the face portion exhibits a larger amount of flexure.

[Durability]

A shaft and a grip were attached to each of the heads to obtain a golf club, and the thus-obtained golf club was set in a swing robot. Hitting with the hit point being the face center FC at a head speed of 50 m/s was performed at most 5000 times. The number of times the head had performed hitting until when the head was broken was recorded. In Table 1 above, "OK" indicates a case where the head was not broken even after 5000 times of hitting.

On the other hand, in a case where the head was broken after hitting of less than or equal to 5000 times, Table 1 shows the number of times the head had performed hitting until when the head was broken.

In the head of Example 1, flexure extended to the body portion, the face portion 4 exhibited an increased amount of flexure, and the natural frequency was low. In the head of Example 2, owing to the presence of the outer surface singularity point Px, the head thickness t1 at the CF inner surface boundary point K1 was greater than that in Example 1. Accordingly, the crown flexure effect was maintained, and the natural frequency was low. Also, owing to the presence of the outer surface singularity point Px, the direction of the hitting face was clear, which allowed addressing to be performed easily. In the head of Comparative Example 1, starting points of bending were the CF inner surface boundary point K1 and the SF inner surface boundary point K2. Accordingly, little flexure was caused in the body portion, and the natural frequency was high. In the head of Comparative Example 2, although the thicknesses at the spot C10 and the spot S15 were small, bending still occurred at the CF inner surface boundary point K1 and the SF inner surface boundary point K2 and flexure thus hardly extended to the body portion. In the head of Comparative Example 3, although the occurrence of bending at the CF inner surface boundary point K1 was suppressed, the amount of flexure was small because the thicknesses at the spot C10 and the spot S15 were large. In the head of Comparative Example 4, although the CF inner surface boundary point K1 and the SF inner surface boundary point K2 were rounded, flexure hardly extended to the body portion because the thicknesses at the CF inner surface boundary point K1 and the SF inner surface boundary point K2 were small. Also in the head of Comparative Example 5, flexure hardly extended to the body portion because the thicknesses at the CF inner surface boundary point K1 and the SF inner surface boundary point K2 were small. In addition, since the thicknesses at the spot C10 and the spot S15 were small, the durability of the head of Comparative Example 5 was inferior to that of the head of Comparative Example 4 although the head of Comparative Example 5 exhibited a lower natural frequency than the head of Comparative Example 4.

Figure 8:
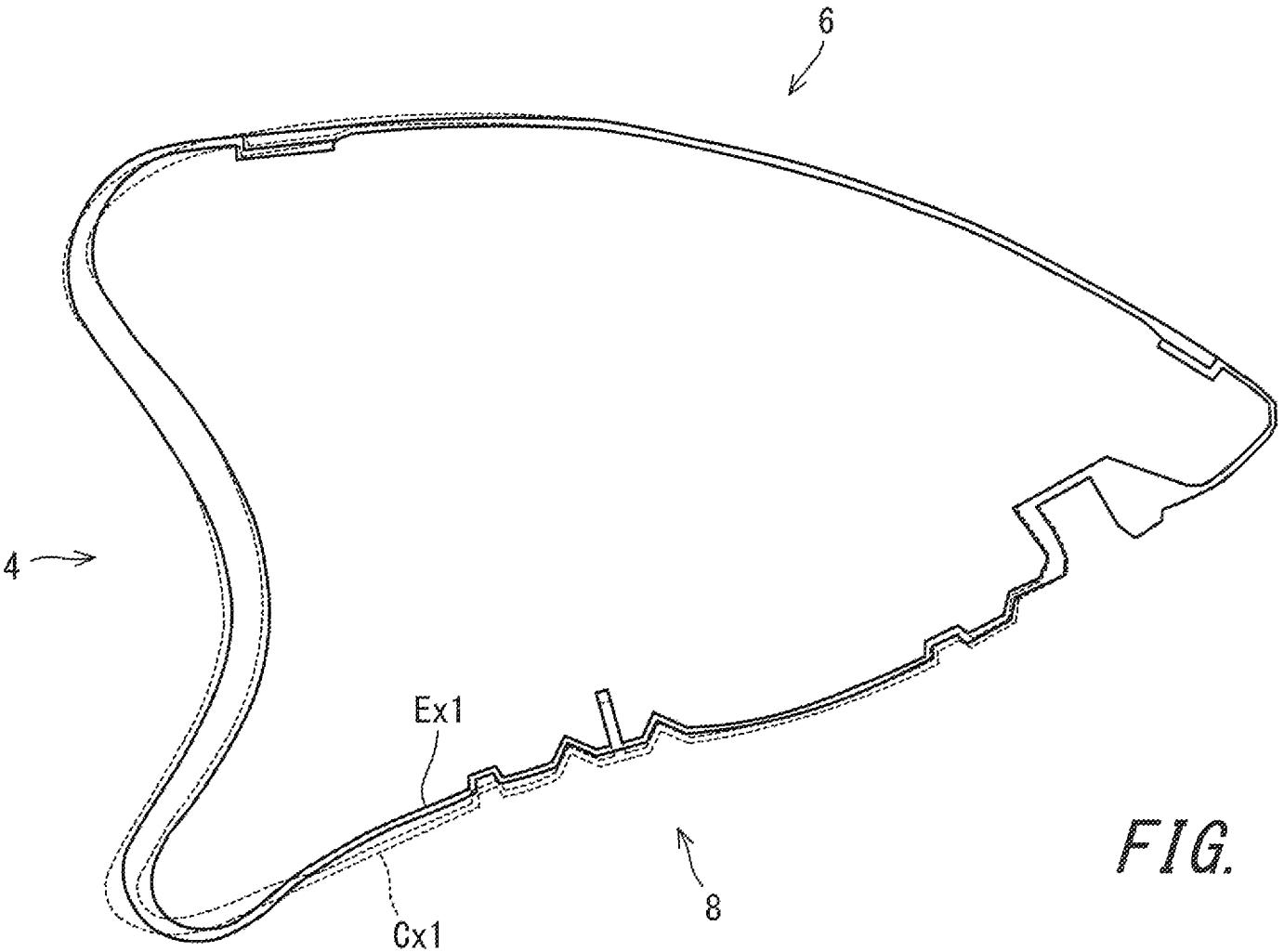
FIG. 8 is cross-sectional views showing simulation results obtained regarding the heads of Example 1 and Comparative Example 1.

Deformation of the heads of Example 1 and Comparative Example 1 was examined through simulations. An FEM model of each of the heads was prepared, and the material properties of the respective members were set. Then, a simulation of causing a ball to collide against the head was performed. A position of the head to be in contact with the ball was set to the face center Fc, and the ball speed was set to 48.87 m/s. FIG. 8 shows the simulation results. In FIG. 8, a cross section Ext of the head of Example 1 is superimposed on a cross section Cx1 of the head of Comparative Example 1 and the deformation magnification was set to 20 times in order to clarify the difference between them.

As shown in FIG. 8, in the head of Example 1, the starting point of flexure is located on a further body side position with respect to the starting point of flexure in the head of Comparative Example 1, and the flexure thus extends to the crown portion 6 and the sole portion 8. In the head of Example 1, the face portion 4 exhibits a higher degree of deformation than the face portion 4 of the head of Comparative Example 1.

The results shown in Table 1 and FIG. 8 demonstrate the advantageous effects of the present disclosure.

Regarding the above-described embodiment, the following clauses are disclosed.

[Clause 1]

A golf club head with a hollow structure, comprising:

a face portion including a hitting face;

a crown portion; and a sole portion, wherein the hitting face includes a face center, a center vertical cross section that passes through the face center and extends in a face-back direction satisfies the following conditions (a) and (b):

(a) when a boundary point between an inner surface of the crown portion and an inner surface of the face portion is defined as a CF inner surface boundary point, a radius of curvature of a head inner surface at the CF inner surface boundary point is greater than or equal to 6.0 mm and less than or equal to 10.0 mm, and a head thickness at the CF inner surface boundary point is greater than or equal to 2.0 mm; and (b) when a spot that is located 10 mm apart from the CF inner surface boundary point toward a crown side is defined as a spot C10, the head thickness reduces gradually from the CF inner surface boundary point to the spot C10, and the head thickness at the spot C10 is less than or equal to 1.0 mm.

[Clause 2]

The golf club head according to clause 1, wherein the center vertical cross section satisfies the following condition (a1):

(a1) when a region of the head inner surface that has a distance of less than or equal to 5 mm from the CF inner surface boundary point is defined as a CF boundary region, the radius of curvature of the head inner surface in the CF boundary region is greater than or equal to 6.0 mm and less than or equal to 10.0 mm.

[Clause 3]

The golf club head according to clause 1 or 2, wherein the center vertical cross section satisfies the following conditions (c) and (d);

(c) when a boundary point between an inner surface of the sole portion and the inner surface of the face portion is defined as an SF inner surface boundary point, the radius of curvature of the head inner surface at the SF inner surface boundary point is greater than or equal to 4.0 mm and less than or equal to 8.0 mm, and the head thickness at the SF inner surface boundary point is greater than or equal to 2.0 mm; and (d) when a spot that is located 15 mm apart from the SF inner surface boundary point toward a sole side (back side) is defined as a spot S15, the head thickness reduces gradually from the SF inner surface boundary point to the spot S15, and the head thickness at the spot S15 is less than or equal to 1.0 mm.

[Clause 4]

The golf club head according to clause 3, wherein the center vertical cross section satisfies the following condition (c1):

(c1) when a region of the head inner surface that has a distance of less than or equal to 5 mm from the SF inner surface boundary point is defined as an SF boundary region, the radius of curvature of the head inner surface in the SF boundary region is greater than or equal to 4.0 mm and less than or equal to 8.0 mm.

[Clause 5]

The golf club head according to any one of clauses 1 to 4, wherein, when a region of the head inner surface that has a distance of less than or equal to 5 mm from the CF inner surface boundary point is defined as a CF boundary region and a region of a head outer surface corresponding to the CF boundary region is defined as a CF outer surface boundary region, the CF outer surface boundary region includes an outer surface singularity point at which a radius of curvature of a head outer surface is smaller than the radius of curvature of the head inner surface at the CF inner surface boundary point in the center vertical cross section.

[Clause 6]

A golf club head with a hollow structure, comprising:

a face portion including a hitting face;

a crown portion; and a sole portion, wherein the hitting face includes a face center, a center vertical cross section that passes through the face center and extends in a face-back direction satisfies the following conditions (c) and (d):

(c) when a boundary point between an inner surface of the sole portion and an inner surface of the face portion is defined as an SF inner surface boundary point, a radius of curvature of a head inner surface at the SF inner surface boundary point is greater than or equal to 4.0 mm and less than or equal to 8.0 mm, and a head thickness at the SF inner surface boundary point is greater than or equal to 2.0 mm; and (d) when a spot that is located 15 mm apart from the SF inner surface boundary point toward a sole side is defined as a spot S15, the head thickness reduces gradually from the SF inner surface boundary point to the spot S15, and the head thickness at the spot S15 is less than or equal to 1.0 mm.

[Clause 7]

The golf club head according to clause 6, wherein the center vertical cross section satisfies the following condition (c1):

(c1) when a region of the head inner surface that has a distance of less than or equal to 5 mm from the SF inner surface boundary point is defined as an SF boundary region, the radius of curvature of the head inner surface in the SF boundary region is greater than or equal to 4.0 mm and less than or equal to 8.0 mm.

LIST OF REFERENCE NUMERALS

2, 20, 30, 40, 50 Golf club head
4 Face portion
4*a* Face outer surface (hitting face)
4*b* Face inner surface
6 Crown portion
6*a* Crown outer surface
6*b* Crown inner surface
8 Sole portion
8*a* Sole outer surface
8*b* Sole inner surface
10 Hosel portion
Fc Face center
K1 CF inner surface boundary point
K2 SF inner surface boundary point
R1 CF boundary region
R2 SF boundary region
R3 CF outer surface boundary region
Px Outer surface singularity point
Ex1 Example 1
Cx1 Comparative Example 1

The above descriptions are merely illustrative and various modifications can be made without departing from the principles of the present disclosure.

What is claimed is:

1. A golf club head with a hollow structure, comprising:

a face portion including a hitting face;

a crown portion; and a sole portion, wherein the hitting face includes a face center, a center vertical cross section that passes through the face center and extends in a face-back direction satisfies the following conditions (a) and (b):

(a) when a boundary point between an inner surface of the crown portion and an inner surface of the face portion is defined as a CF inner surface boundary point, a radius of curvature of a head inner surface at the CF inner surface boundary point is greater than or equal to 6.0 mm and less than or equal to 10.0 mm, and a head thickness at the CF inner surface boundary point is greater than or equal to 2.0 mm; and (b) when a spot that is located 10 mm apart from the CF inner surface boundary point away from the face portion and toward a crown side is defined as a spot C10, the head thickness reduces gradually from the CF inner surface boundary point to the spot C10, and the head thickness at the spot C10 is less than or equal to 1.0 mm, a cross section that extends in the face-back direction and also extends in an up-down direction is defined as a vertical cross section, a portion where the radius of curvature in the vertical cross section is smallest is present in a vicinity of a boundary between the inner surface of the crown portion and the inner surface of the face portion, and the portion having the smallest radius of curvature is a point which is the CF inner surface boundary point.

2. The golf club head according to claim 1, wherein the center vertical cross section satisfies the following condition (a1):

(a1) when a region of the head inner surface that extends from a spot located 5 mm apart from the CF inner surface boundary point away from the face portion and toward the crown side to a spot located 5 mm apart from the CF inner surface boundary point toward the face portion is defined as a CF boundary region, the radius of curvature of the head inner surface in the CF boundary region is greater than or equal to 6.0 mm and less than or equal to 10.0 mm.

3. The golf club head according to claim 1, wherein the center vertical cross section satisfies the following conditions (c) and (d);

(c) when a boundary point between an inner surface of the sole portion and the inner surface of the face portion is defined as an SF inner surface boundary point, a radius of curvature of the head inner surface at the SF inner surface boundary point is greater than or equal to 4.0 mm and less than or equal to 8.0 mm, and the head thickness at the SF inner surface boundary point is greater than or equal to 2.0 mm; and (d) when a spot that is located 15 mm apart from the SF inner surface boundary point away from the face portion and toward a sole side is defined as a spot S15, the head thickness reduces gradually from the SF inner surface boundary point to the spot S15, and the head thickness at the spot S15 is less than or equal to 1.0 mm.

4. The golf club head according to claim 3, wherein the center vertical cross section satisfies the following condition (c1):

(c1) when a region of the head inner surface that extends from a spot located 5 mm apart from the SF inner surface boundary point away from the face portion and toward the sole side to a spot located 5 mm apart from the SF inner surface boundary point toward the face portion is defined as an SF boundary region, the radius of curvature of the head inner surface in the SF boundary region is greater than or equal to 4.0 mm and less than or equal to 8.0 mm.

5. The golf club head according to claim 1, wherein, when a region of the head inner surface that extends from a spot located 5 mm apart from the CF inner surface boundary point away from the face portion and toward the crown side to a spot located 5 mm apart from the CF inner surface boundary point toward the face portion is defined as a CF boundary region and a region of a head outer surface corresponding to the CF boundary region is defined as a CF outer surface boundary region, the CF outer surface boundary region includes an outer surface singularity point at which a radius of curvature of a head outer surface is smaller than the radius of curvature of the head inner surface at the CF inner surface boundary point in the center vertical cross section.

6. The golf club head according to claim 5, wherein the radius of curvature of the head outer surface at the outer surface singularity point is less than or equal to 5.0 mm.

7. The golf club head according to claim 5, wherein when an intersection point between the head outer surface and a line normal to the head inner surface at the CF inner surface boundary point is defined as an outer surface point, the outer surface singularity point is located at a position on a face side with respect to the outer surface point.

8. The golf club head according to claim 5, wherein when an intersection point between the head outer surface and a line normal to the head inner surface at the CF inner surface boundary point is defined as an outer surface point, a distance between the outer surface singularity point and the outer surface point is less than or equal to 4 mm.

9. A golf club head with a hollow structure, comprising:

a face portion including a hitting face;

a crown portion; and a sole portion, wherein the hitting face includes a face center, a center vertical cross section that passes through the face center and extends in a face-back direction satisfies the following conditions (c) and (d):

(c) when a boundary point between an inner surface of the sole portion and an inner surface of the face portion is defined as an SF inner surface boundary point, a radius of curvature of a head inner surface at the SF inner surface boundary point is greater than or equal to 4.0 mm and less than or equal to 8.0 mm, and a head thickness at the SF inner surface boundary point is greater than or equal to 2.0 mm; and (d) when a spot that is located 15 mm apart from the SF inner surface boundary point away from the face portion and toward a sole side is defined as a spot S15, the head thickness reduces gradually from the SF inner surface boundary point to the spot S15, and the head thickness at the spot S15 is less than or equal to 1.0 mm.

10. The golf club head according to claim 9, wherein the center vertical cross section satisfies the following condition (c1):

(c1) when a region of the head inner surface that extends from a spot located 5 mm apart from the SF inner surface boundary point away from the face portion and toward the sole side to a spot located 5 mm apart from the SF inner surface boundary point toward the face portion is defined as an SF boundary region, the radius of curvature of the head inner surface in the SF boundary region is greater than or equal to 4.0 mm and less than or equal to 8.0 mm.

11. The golf club head according to claim 9, wherein a cross section that extends in the face-back direction and also extends in an up-down direction is defined as a vertical cross section, in a vicinity of a boundary between the inner surface of the sole portion and the inner surface of the face portion, a portion where the radius of curvature in the vertical cross section is smallest is present, the portion having the smallest radius of curvature is a point, and this point is the SF inner surface boundary point.

12. The golf club head according to claim 9, wherein a cross section that extends in the face-back direction and also extends in an up-down direction is defined as a vertical cross section, in a vicinity of a boundary between the inner surface of the sole portion and the inner surface of the face portion, a portion where the radius of curvature in the vertical cross section is smallest is present, the portion having the smallest radius of curvature is an arc, and a midpoint of the arc is the SF inner surface boundary point.

13. A golf club head with a hollow structure, comprising:

a face portion including a hitting face;

a crown portion; and a sole portion, wherein the hitting face includes a face center, a center vertical cross section that passes through the face center and extends in a face-back direction satisfies the following conditions (a) and (b):

(a) when a boundary point between an inner surface of the crown portion and an inner surface of the face portion is defined as a CF inner surface boundary point, a radius of curvature of a head inner surface at the CF inner surface boundary point is greater than or equal to 6.0 mm and less than or equal to 10.0 mm, and a head thickness at the CF inner surface boundary point is greater than or equal to 2.0 mm; and (b) when a spot that is located 10 mm apart from the CF inner surface boundary point away from the face portion and toward a crown side is defined as a spot C10, the head thickness reduces gradually from the CF inner surface boundary point to the spot C10, and the head thickness at the spot C10 is less than or equal to 1.0 mm, a cross section that extends in the face-back direction and also extends in an up-down direction is defined as a vertical cross section, a portion where the radius of curvature in the vertical cross section is smallest is present in a vicinity of a boundary between the inner surface of the crown portion and the inner surface of the face portion, the portion having the smallest radius of curvature is an arc, and a midpoint of the arc is the CF inner surface boundary point.

14. A golf club head with a hollow structure, comprising:

a face portion including a hitting face;

a crown portion; and a sole portion, wherein the hitting face includes a face center, a center vertical cross section that passes through the face center and extends in a face-back direction satisfies the following conditions (a) and (b):

(a) when a boundary point between an inner surface of the crown portion and an inner surface of the face portion is defined as a CF inner surface boundary point, a radius of curvature of a head inner surface at the CF inner surface boundary point is greater than or equal to 6.0 mm and less than or equal to 10.0 mm, and a head thickness at the CF inner surface boundary point is greater than or equal to 2.0 mm; and (b) when a spot that is located 10 mm apart from the CF inner surface boundary point away from the face portion and toward a crown side is defined as a spot C10, the head thickness reduces gradually from the CF inner surface boundary point to the spot C10, and the head thickness at the spot C10 is less than or equal to 1.0 mm, when cross sections that extend in the face-back direction and also extend in an up-down direction are defined as vertical cross sections, the conditions (a) and (b) are satisfied in any vertical cross section present in a region extending from a position located 10 mm apart toward a toe side from the face center to a position located 10 mm apart toward a heel side from the face center.

15. The golf club head according to claim 14, wherein when cross sections that extend in the face-back direction and also extend in an up-down direction are defined as vertical cross sections, the conditions (a) and (b) are satisfied in any vertical cross section present in a region extending from a position located 15 mm apart toward a toe side from the face center to a position located 15 mm apart toward a heel side from the face center.

* * * * *